US006280151B1

(12) United States Patent
Murakami et al.

(10) Patent No.: US 6,280,151 B1
(45) **Date of Patent: *Aug. 28, 2001**

(54) SINGLE-ENDED SWASH PLATE COMPRESSOR

(75) Inventors: Kazuo Murakami; Toshiro Fujii; Naoya Yokomachi; Takayuki Imai; Tatsuya Koide, all of Aichi-ken (JP)

(73) Assignee: Kabushiki Kaisha Toyoda Jidoshokki Seisakusho, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/262,599

(22) Filed: Mar. 4, 1999

(30) Foreign Application Priority Data

Mar. 9, 1998 (JP) ..... 10-056987
Mar. 10, 1998 (JP) ..... 10-058492

(51) Int. Cl.[7] ..... F04B 1/26
(52) U.S. Cl. ..... 417/222.2; 417/269
(58) Field of Search ..... 417/269, 569, 417/222

(56) References Cited

U.S. PATENT DOCUMENTS 5,536,149 7/1996 Fujii et al. ..... 417/269
5,607,287 * 3/1997 Ikeda et al. ..... 417/269
5,694,784 12/1997 Frey et al. ..... 62/228.5
6,010,313 * 1/2000 Kimura et al. ..... 417/222.2

FOREIGN PATENT DOCUMENTS 39 28 162 A1 3/1990 (DE) .
0 864 751 A2 9/1996 (EP) .

* cited by examiner

*Primary Examiner*—Charles G. Freay
(74) *Attorney, Agent, or Firm*—Morgan & Finnegan, L.L.P.

(57) ABSTRACT

In a single-ended swash plate compressor, unbalanced thrust loads in either axial direction are reduced so that thrust loads acting on pistons in the direction of the front end are practically balanced by those in the direction of the rear end, for example, by connecting an intake chamber to a swash plate chamber by means of an adjustment valve to adjust the pressure in the swash plate chamber acting on the front end surfaces of the pistons to a suitable intermediate pressure by the action of the adjustment valve. In a single-ended swash plate compressor with pistons housed in both ends of a cylinder assembly comprising one set of pistons for guidance and another set for compression, discharge pressure is introduced into some of the cylinder bores housing guide pistons and intake pressure is introduced into the cylinder bores housing guide pistons into which discharge pressure is not introduced.

9 Claims, 14 Drawing Sheets

SINGLE-ENDED SWASH PLATE COMPRESSOR

BACKGROUND OF THE INVENTION

1. Field of the Invention

The present invention relates to a single-ended swash plate compressor for use in automotive vehicles and the like.

2. Description of the Related Art

Swash plate compressors, in which a plurality of cylinder bores are disposed parallel to a drive shaft in a peripheral portion of a cylinder block, with piston assemblies housed in the cylinder bores, the piston assemblies being reciprocated by a swash plate which rotates together with the drive shaft so as to compress a refrigerant gas, are in general use as compressors for conventional automotive air-conditioners. Moreover, double-ended swash plate compressors, which include double-headed piston assemblies in which compression pistons are formed on both ends of piston rods and a compression action is performed at both the front end and the rear end of the piston bores, are often used. However, when using carbon dioxide (C02) as a refrigerant as an alternative to chloro fluorocarbons, there are cases where single-ended swash plate compressors are used.

Generally-known conventional single-ended swash plate compressors include single-headed piston assemblies in which compression pistons are formed on one end of the piston rods only and the compression action is performed at one end of the piston bores, for example, the rear end only.

The fixed-capacity single-ended swash plate compressor shown in FIG. 13 is a known example of such a swash plate compressor.

In the figure, the outer shell 201 of the compressor is formed by joining a front housing 201*b* to the front end of a cylinder block 201*a*, forming a swash plate chamber 202 within. A cylinder cover 203 functioning as a rear housing having a discharge chamber 203*a* and an intake chamber 203*b* therein is joined to the rear end of the cylinder block 201*a* by means of a valve plate 204. An intake port 205 for receiving intake gas from an external refrigerant circuit (not shown) is disposed in a side wall of the cylinder cover 203 and is connected to the intake chamber 203*b*. A drive shaft 206 is disposed in a central portion of the outer shell 201 of the compressor and is rotatably supported by radial bearings 207. A plurality of cylinder bores 208 are formed in the cylinder block 201*a* parallel to the drive shaft 206 and equidistantly spaced in a circle of fixed circumference centered on the drive shaft 206. Consequently, a cylinder assembly is formed by the cylinder block 201*a*. Piston assemblies 209 each comprise a piston rod 209*b* and a single-headed piston 209*a* formed on the rear end of the piston rod 209*b*. A single-headed piston 209*a* is housed within each of the cylinder bores 208 so as to be free to slide and reciprocate.

A swash plate 210 is secured to the drive shaft 206 within the swash plate chamber 202 so as to rotate together with the drive shaft 206, the pistons 209*a* being engaged by the swash plate 210 by means of shoes 211. Furthermore, a thrust bearing 214 is disposed at the front end of a boss portion 210*a* of the swash plate 210, that is to say, between the boss portion 210*a* and the front housing 201*b*, thrust loads acting on the swash plate 210 being supported by the thrust bearing 214.

Discharge holes 204*a* connecting each of the cylinder bores 208 to the discharge chamber 203*a* and intake holes 204*b* connecting each of the cylinder bores 208 to the intake chamber 203*b* are disposed in the valve plate 204. An intake valve-forming plate 212 integrally formed with a plurality of intake valves 212*a* for controlling the opening and closing of each of the intake holes 204*b* is interposed between the valve plate 204 and the cylinder block 201*a*, and a discharge valve-forming plate 213 integrally formed with a plurality of discharge valves 213*a* for controlling the opening and closing of each of the discharge holes 204*a* is interposed between the valve plate 204 and the cylinder cover 203.

Gas passages 215 are disposed in the cylinder block 201*a* in the spaces between the plurality of cylinder bores 208, the swash chamber 202 being connected to the intake chamber 203*b* by means of the gas passages 215, so that blowback gas flowing into the swash chamber 202 during the process of compression by the pistons 209*a* is expelled to the intake chamber 203*b*.

Moreover, 216 is a retainer, 217 is a discharge port, and 218 is a bolt joining the cylinder block 201*a*, the front housing 201*b*, and the cylinder cover 203 together.

When a single-ended swash plate compressor constructed in the above manner is activated, intake gas is directed from the external refrigerant circuit through the intake port 205 into the intake chamber 203*b*. Then, the refrigerant gas is taken from the intake chamber 203*b* through the intake holes 204*b* and intake valves 212*a* into the cylinder bores 208 and is compressed by the pistons 209*a*. The compressed refrigerant gas is expelled through the discharge holes 204*a* and the discharge valves 213*a* to the discharge chamber 203*a* and is discharged through the discharge port 217 to the external refrigerant circuit.

In a single-ended swash plate compressor constructed in the above manner, the front ends of the pistons 209*a* (left side in figure) are exposed to the swash chamber which is at intake pressure, and at the same time the rear ends of the pistons 209*a* are exposed to the cylinder bores 208 which are filled with compressed refrigerant gas, Thus, the internal pressure (intake pressure) of the swash chamber 202 acts on the front end surface of each of the pistons 209*a*, and the internal pressure of the cylinder bores 208 acts on the rear end surface of each of the pistons 209*a*. FIG. 14 is a graph explaining the conditions in one piston and shows the changes in the internal pressure Pc in the swash plate chamber 202 and the changes in the internal pressure Pb in the cylinder bore 208 relative to the rotational angle of the swash plate 210 (in degrees). As shown in this diagram, the internal pressure Pc in the swash plate chamber 202 always remains at a practically constant low pressure, that is at the intake pressure, but the internal pressure Pb in the cylinder bore 208 fluctuates periodically between a low intake pressure and a high discharge pressure depending on the rotational angle of the swash plate 210.

Now, thrust loads from the front end towards the rear end act on the front end surfaces of the pistons 209*a*, and thrust loads from the rear end towards the front end act on the rear end surfaces of the pistons 209*a*. Thus, the thrust load acting on the thrust bearing 214 is given by the sum of these loads acting on the pistons 209*a*.

FIG. 15 is a graph explaining the axial load, and the vertical axis shows the thrust load, the direction from the rear end towards the front end being taken as positive. The number of pistons 209*a* has been taken to be six and the loads acting on all six pistons have been totalled. In FIG. 15, Ff indicates the thrust load acting from the front end towards the rear end due to the internal pressure in the swash chamber 202. Fr indicates the thrust load acting from the rear end towards the front end due to the internal pressure in the cylinder bores 208. Ft indicates the total load resulting from Ff and Fr. Since Ft is the sum of all of the loads acting on a plurality of pistons (in this case six), the amplitudes and periods of the fluctuations are small compared to those of the internal pressure in the single cylinder bore 208 shown in FIG. 14.

Now, as can be understood from FIGS. 14 and 15, because the difference between the internal pressure Pb in the cylinder bores 208 and the internal pressure Pc in the swash plate chamber 202 is great, the difference between the thrust load Ff acting from the front end towards the rear end and the thrust load Fr acting from the rear end towards the front end is great, making the overall total thrust load Ft a large unbalanced load from the rear end towards the front end. This unbalanced load is transmitted through the shoes 211 to the swash plate 210 and is supported by the thrust bearing 214 disposed at the front end of the boss portion 210*a* of the swash plate 210 so as to support the thrust load from the swash plate 210.

Thus, in a conventional fixed-capacity single-ended swash plate compressor, because compression is performed on only one side of the swash plate, the load acting on the thrust bearing 214 disposed at the front end of the boss portion 210*a* of the swash plate 210 is great. In particular, the working pressure when carbon dioxide is used as the refrigerant is greater than when chloro fluorocarbons or the like are used, which tends to shorten the working life of the thrust bearing 214 disposed at the front end of the swash plate 210, and a thrust bearing 214 with a high load rating is required to prevent this. However, the problem is that by using a thrust bearing 214 with a high load rating, the size of the thrust bearing 214 at the front end is increased, in turn leading to increases in the size and weight of the compressor.

SUMMARY OF THE INVENTION

The present invention aims to solve the above problems and an object of the present invention is to provide a single-ended swash plate compressor which reduces the load acting on the thrust bearing, and suppresses shortening of the working life of the thrust bearing and increases in the size of the thrust bearing.

In order to achieve the above object, according to the present invention, there is provided a single-ended swash plate compressor having a means of substantially balancing the thrust load acting on the pistons in both axial directions by adjusting the pressure of the refrigerant acting in a direction opposite to the thrust load directed towards the front end due to internal pressure in the cylinder bores acting on the pistons. According to another embodiment of the present invention, there is provided a single-ended swash plate compressor having an adjustment means for adjusting the internal pressure of the swash plate chamber acting on the front end surface of the pistons to an intermediate pressure between the intake pressure and the discharge pressure, whereby the thrust load directed towards the front end due to internal pressure in the cylinder bores acting on the pistons and the thrust load directed towards the rear end due to the internal pressure of the swash plate chamber are practically balanced.

These constructions eliminate imbalances in the loads acting on the thrust bearing, reducing the overall size of the thrust load.

In the present invention, the thrust load fluctuates in both axial directions, but according to the present invention, the thrust load fluctuating in both axial directions can be supported by the provision of thrust bearings at both the front end and the rear end of the swash plate.

According to the present invention, by providing an adjustment means, such as disposing the intake port which receives intake gas from the refrigerant circuit external to the compressor in connection with the intake chamber, connecting the intake chamber to the swash plate chamber by means of an adjustment valve and maintaining the swash plate chamber at a predetermined intermediate pressure by the action of the adjustment valve, the internal pressure in the swash plate chamber can be set at any desired intermediate pressure suitable to the working conditions, such as the refrigerant used, the specifications of the compressor, the operating environment, etc.

According to the present invention, by establishing a relationship between the intake pressure, the discharge pressure, and the intermediate pressure, it is possible to use carbon dioxide which is a promising substitute for chloro fluorocarbons as a refrigerant medium.

The single-ended swash plate compressor according to another embodiment of the present invention is constructed such that cylinder bores are formed in both the front end and the rear end, and a compression action is performed in the cylinder bores at one end by pistons housed within the cylinder bores at that end, and a guide action is performed in the cylinder bores at the other end by pistons housed within the cylinder bores at that other end, whereby pressure is introduced into the cylinder bores in the guide end to cancel the reactive forces due to compression acting on the pistons in the compression end.

By this construction, the thrust load acting from the rear end to the front end due to pressure within the cylinder bores in the compression end is cancelled by a thrust load from the front end to the rear end, reducing unbalanced thrust loads in either axial direction.

Furthermore, as means of introducing a pressure into the cylinder bores in the guide end to cancel the reactive forces due to compression acting on the pistons in the compression end, the single-ended swash plate compressor according to the present invention is constructed such that discharge pressure is introduced into some of the cylinder bores in the guide end, enabling the thrust loads in both axial directions to be balanced by a simple construction.

According to the present invention, by introducing intake pressure into the cylinder bores in the guide end to which discharge pressure is not introduced, the internal pressure in each of the cylinder bores in the guide end is stabilized, thereby stabilizing the thrust load acting from the front end to the rear end.

According to the present invention, piston rings are mounted on the outer circumferential sliding surfaces of the pistons housed in the cylinder bores in the guide end into which discharge pressure is introduced, whereby the blowback of gas from those cylinder bores to the swash plate chamber can be reduced.

According to the present invention, the diameter of the cylinder bores in the guide end is made smaller than the diameter of the cylinder bores in the compression end and discharge pressure is introduced into each of these cylinders in the guide end, whereby the thrust loads in both axial directions can be balanced by the ratio between the area of the piston assemblies subjected to the pressure of the cylinder bores in the guide end and the area of the piston assemblies subjected to the pressure of the cylinder bores in the compression end.

DETAILED DESCRIPTION OF THE PREFERRED EMBODIMENTS

The actual embodiments of swash plate compressors according to the present invention will now be explained using FIGS. 1 to 12.

Embodiment 1

Figure 1:
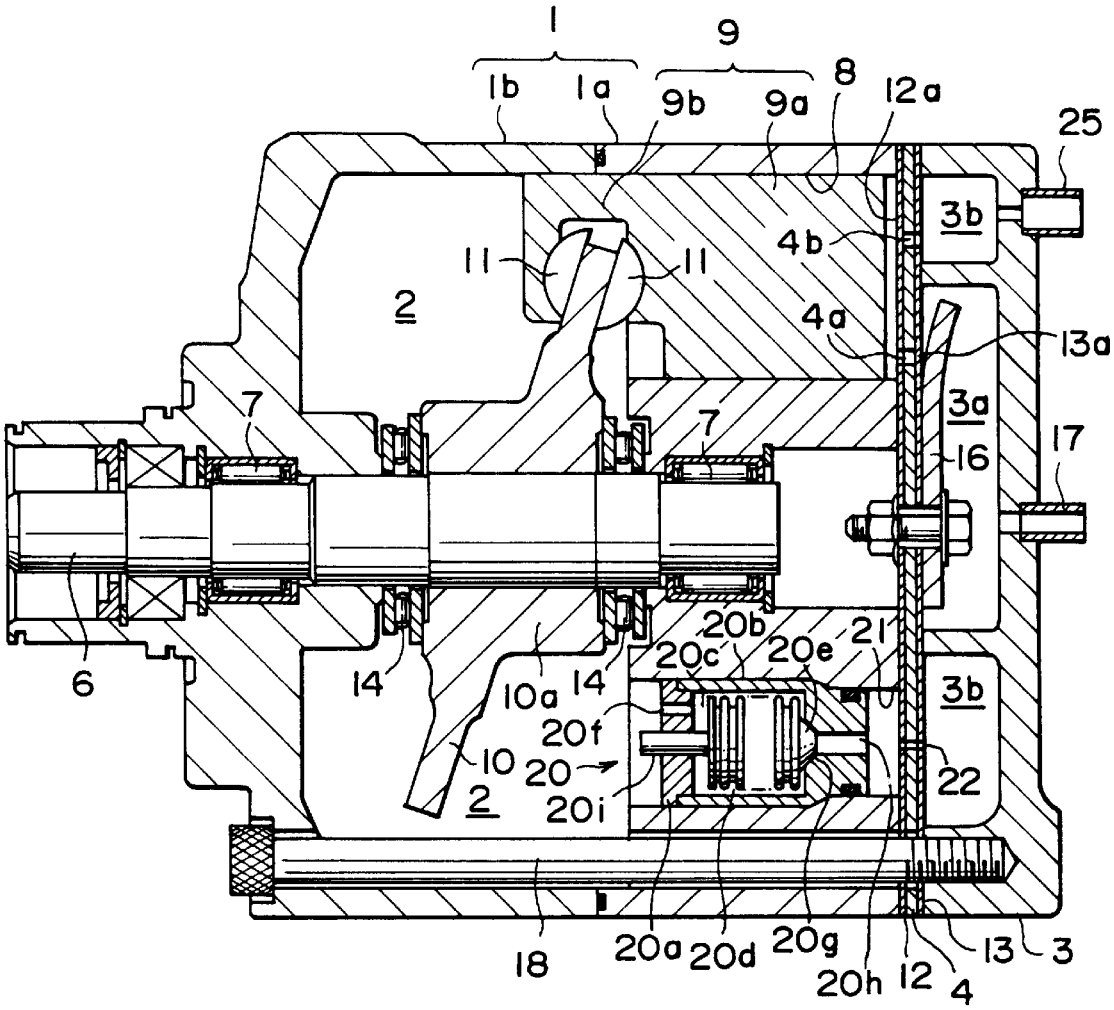
FIG. 1 is a longitudinal section of a single-ended swash plate compressor according to Embodiment 1 of the present invention.
Figure 2:
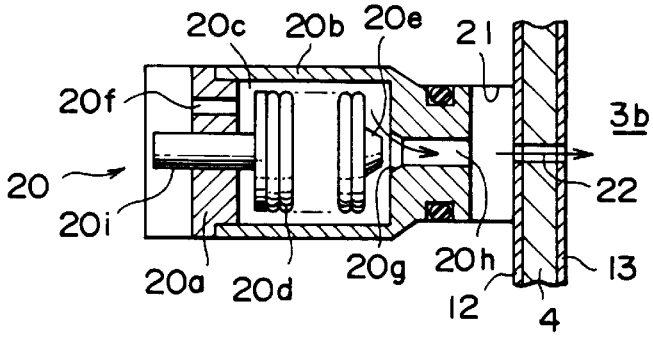
FIG. 2 is a partial cross-section explaining the operation of an adjustment valve in Embodiment 1 of the present invention.
Figure 13:
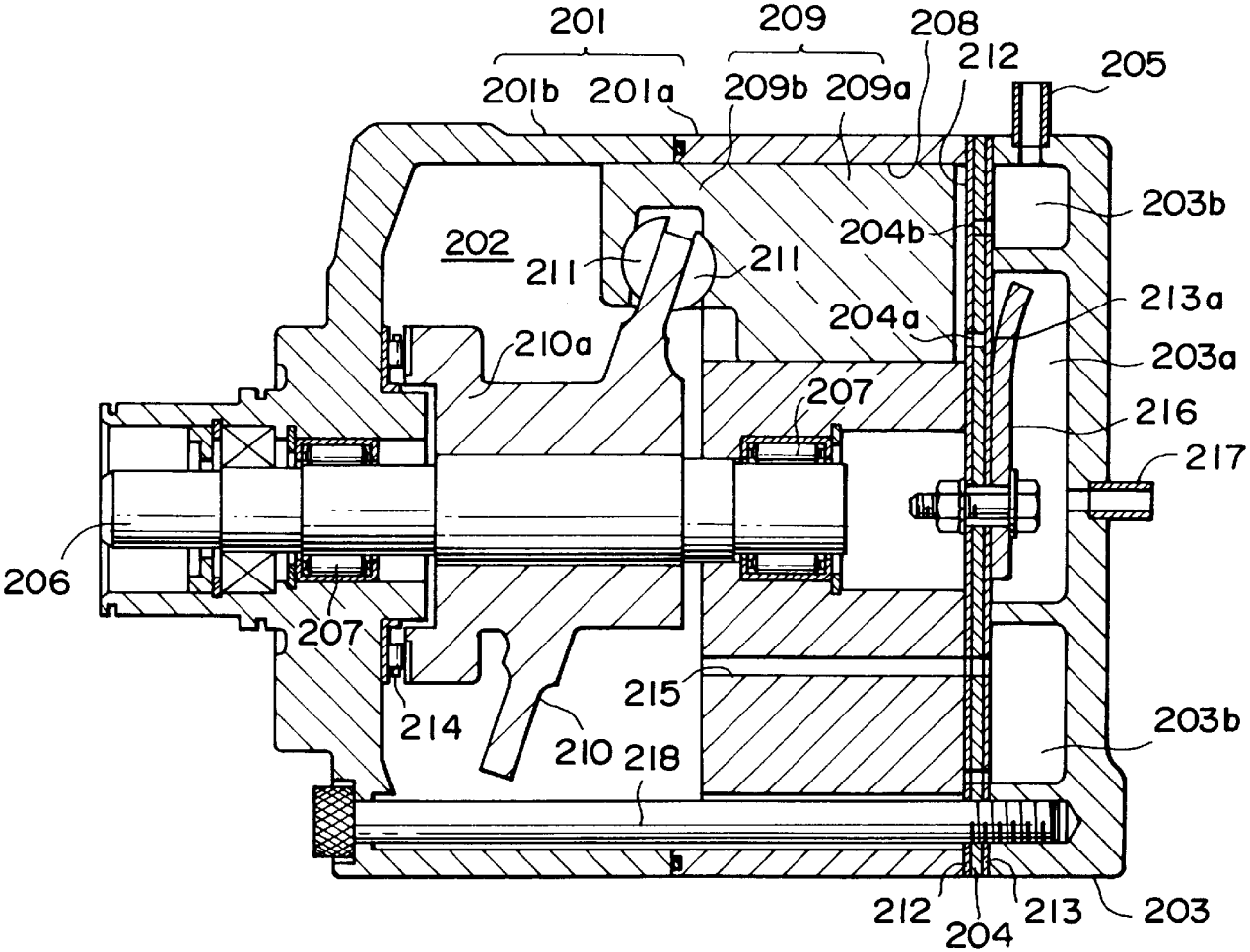
FIG. 13 is a longitudinal section of a conventional single-ended swash plate compressor.
Figure 14:
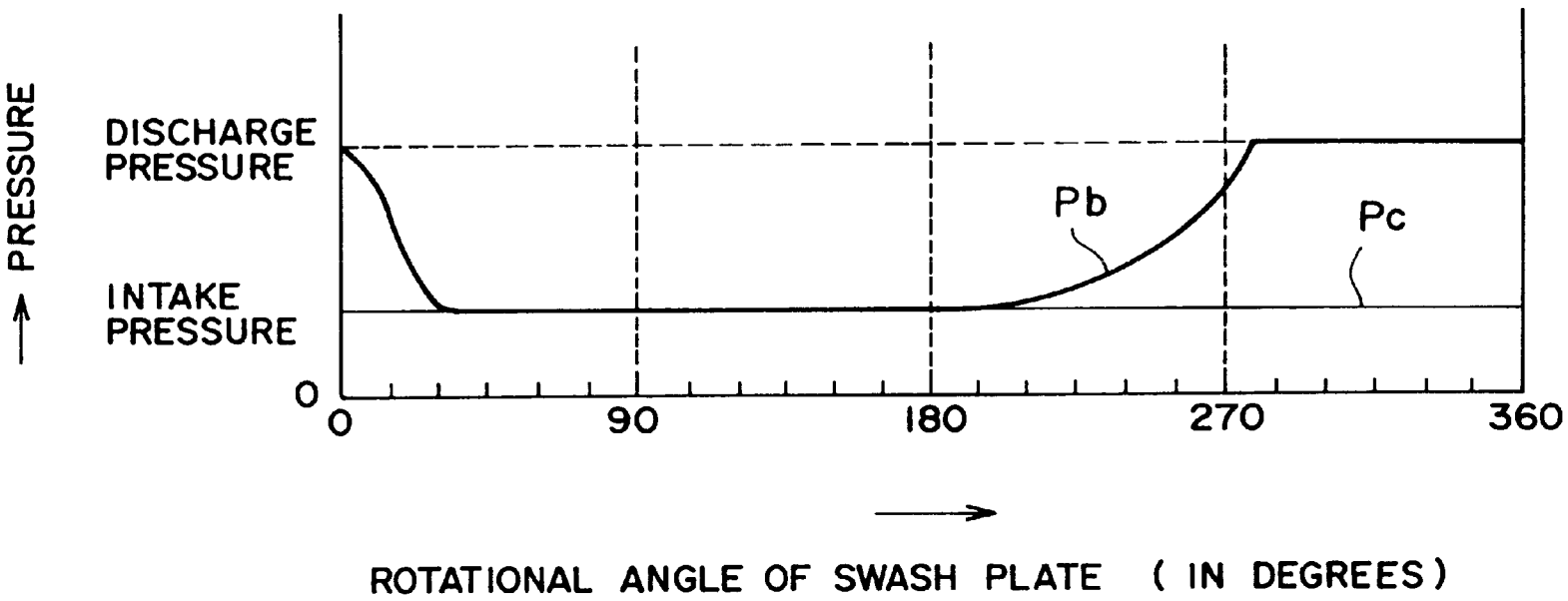
FIG. 14 is a graph explaining the usual changes in pressure in a cylinder bore.
Figure 15:
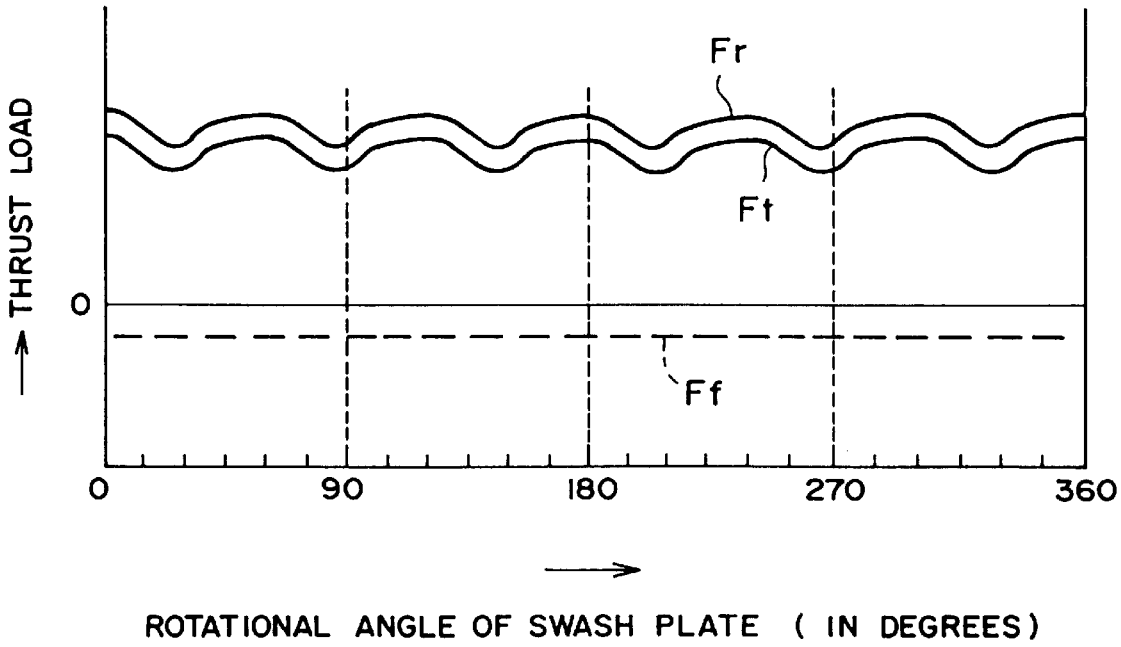
FIG. 15 is a graph explaining the balance of thrust loads in a conventional single-ended swash plate compressor.

Firstly, Embodiment 1 will be explained with reference to FIGS. 1 to 3. FIG. 1 is a cross-section similar to that of FIG. 13 for the conventional example above and shows a single-ended swash plate compressor according to the present invention which uses carbon dioxide as a refrigerant. In the figure, the outer shell 1 of the compressor is formed by joining a front housing 1*b* to the front end of a cylinder block 1*a*. The joining thereof forms a swash plate chamber 2 within the outer shell 1. A cylinder cover 3 functioning as a rear housing formed with a discharge chamber 3*a* in a central region and an intake chamber 3*b* in a peripheral portion is joined to the rear end of the cylinder block 1*a* by means of a valve plate 4.

One end of a drive shaft 6 is inserted into an axial center portion of the cylinder block 1*a* and the other end passes through an axial center portion of the front housing 1*b* and extends outside, the drive shaft 6 being rotatably supported by radial bearings 7 disposed in the cylinder block 1*a* and the front housing 1*b*, respectively. A plurality of cylinder bores 8 are formed in the cylinder block 1*a* parallel to the drive shaft 6 and equidistantly spaced in a circle of fixed circumference centered on the drive shaft 6, and a single-headed piston 9*a* is housed within each of these cylinder bores 8 so as to be free to slide and reciprocate. Moreover, 9 represents piston assemblies each comprising a piston rod 9*b* and a piston 9*a* formed on the rear end of the piston rod 9*b*. A cylinder assembly is constituted by the cylinder block 1*a* formed in this manner.

A swash plate 10 is secured to the drive shaft 6 within the swash plate chamber 2 so as to rotate together with the drive shaft 6. The pistons 9*a* are engaged by the swash plate 10 by means of shoes 11. Furthermore, thrust bearings 14 are disposed at both the front end and the rear end of a boss portion 10*a* of the swash plate 10, that is to say, between the boss portion 10*a* and the front housing 1*b* and between the boss portion 10*a* and the cylinder block 1*a*, thrust loads acting on the swash plate 10 being supported by the thrust bearings 14.

Discharge holes 4*a* connecting each of the cylinder bores 8 to the discharge chamber 3*a* and intake holes 4*b* connecting each of the cylinder bores 8 to the intake chamber 3*b* are disposed in the valve plate 4. An intake valve-forming plate 12 integrally formed with a plurality of intake valves 12*a* for controlling the opening and closing of each of the intake holes 4*b* is interposed between the valve plate 4 and the cylinder block 1*a*, and a discharge valve-forming plate 13 integrally formed with a plurality of discharge valves 13*a* for controlling the opening and closing of each of the discharge holes 4*a* is interposed between the valve plate 4 and the cylinder cover 3.

25 is an intake port and is disposed in the end wall of the intake chamber 3*b*, that is to say, the end wall of the intake chamber 3*b* portion of the cylinder cover. A retainer 16 for controlling the opening angle of the discharge valves 13*a* is disposed in a central portion of the discharge chamber 3*a* in contact with the discharge valve-forming plate 13. In addition, a discharge port 17 connected to the external refrigerant circuit is disposed in the central portion of the cylinder cover 3 forming the discharge chamber 3*a*. Moreover, 18 is a bolt joining the cylinder block 1*a*, the front housing 1*b*, and the cylinder cover 3 together.

In Embodiment 1, the adjustment means for adjusting the internal pressure of the swash plate chamber 2 to an intermediate pressure between the intake pressure and the discharge pressure is an adjustment valve 20 described below and is disposed and constructed in the manner described below.

An adjustment valve accommodating hole 21 is formed in the cylinder block 1*a*, and a control passage 22 connecting the accommodating hole 21 to the intake chamber 3*b* is formed so as to pass through the valve plate 4, the intake valve-forming plate 12, and the discharge valve-forming plate 13. The adjustment valve 20 is accommodated within the accommodating hole 21 so as to be able to open and close the connection between the swash plate chamber 2 and the intake chamber 3*b*. More specifically, the adjustment valve 20 comprises: a securing portion 20*a* screwed into the portion of the accommodating hole 21 opening onto the swash plate chamber side; a case 20*b* forming a pressure sensing chamber 20*c* within; a bellows 20*d* functioning as a pressure sensing portion disposed within the pressure sensing chamber 20*c*; and a valve body 20*e* which opens and closes a port 20*h* by opening and closing a valve seat 20*g* in response to the contraction and expansion of the bellows 20*d*. A connecting passage 20*f* for introducing the pressure of the swash plate chamber 2 into the pressure sensing chamber 20*c* is formed in the securing portion 20*a*, the bellows 20*d* expanding and contracting in response to changes in pressure in the swash plate chamber 2. Moreover, 20*i* is an adjustor portion for modifying the set pressure of the bellows 20*d* by adjusting the position thereof relative to the securing portion 20*a*, the set pressure in Embodiment 1 being adjusted to a suitable intermediate pressure between the intake pressure and the discharge pressure.

When a single-ended swash plate compressor constructed in the above manner is activated, intake gas is drawn from the external refrigerant circuit through the intake port 25 into the intake chamber 3*b*. Then, the intake gas is drawn through the intake holes 4*b* and intake valves 12*a* into the cylinder bores 8 and is compressed by the pistons 9*a*. The compressed refrigerant gas is expelled through the discharge holes 4*a* and the discharge valves 13*a* to the discharge chamber 3*a* and is discharged from the discharge port 17 to the external refrigerant circuit. During this operation, the pressure in the swash plate chamber 2 is maintained at a desired level by the action of the adjustment valve 20 described above. More specifically, because some of the refrigerant gas in the cylinder bores 8 leaks through the clearances between the pistons 9*a* and cylinder bores 8 into the swash plate chamber 2 as blowback gas, when the adjustment valve 20 is closed, the internal pressure of the swash plate chamber 2 gradually increases. The internal pressure of the swash plate chamber 2 is introduced into the pressure sensing chamber 20*c* by means of the connecting passage 20*f*, and when the internal pressure of the swash plate chamber 2 rises above the predetermined intermediate pressure due to blowback gas, the bellows 20*d* contracts in response thereto as shown in FIG. 2. Consequently, the valve body 20*e* opens the port 20*h*, and pressure from the swash plate chamber 2 is released through the port 20*h* and the control passage 22 to the intake chamber 3*b* until the pressure decreases to the predetermined intermediate pressure.

Consequently, the swash plate chamber 2 is maintained at the predetermined intermediate pressure during operation, and the intermediate pressure acts on the front end surfaces of the pistons 9*a*. The fluctuating internal pressure in the cylinder bores 8 acts on the rear end surfaces of the pistons 9*a*. Carbon dioxide is used as the refrigerant in this embodiment, and here, can be handled under normal conditions with the thrust loads in both axial directions in balance if the intermediate pressure in the swash plate chamber 2 is adjusted by the adjustment valve 20 such that:

$$Pm \approx Ps*(1-x)+Pd*x,$$

provided that x=0.25 to 0.4, where Ps is the intake pressure, Pd is the discharge pressure, and Pm is the intermediate pressure.

Figure 3:
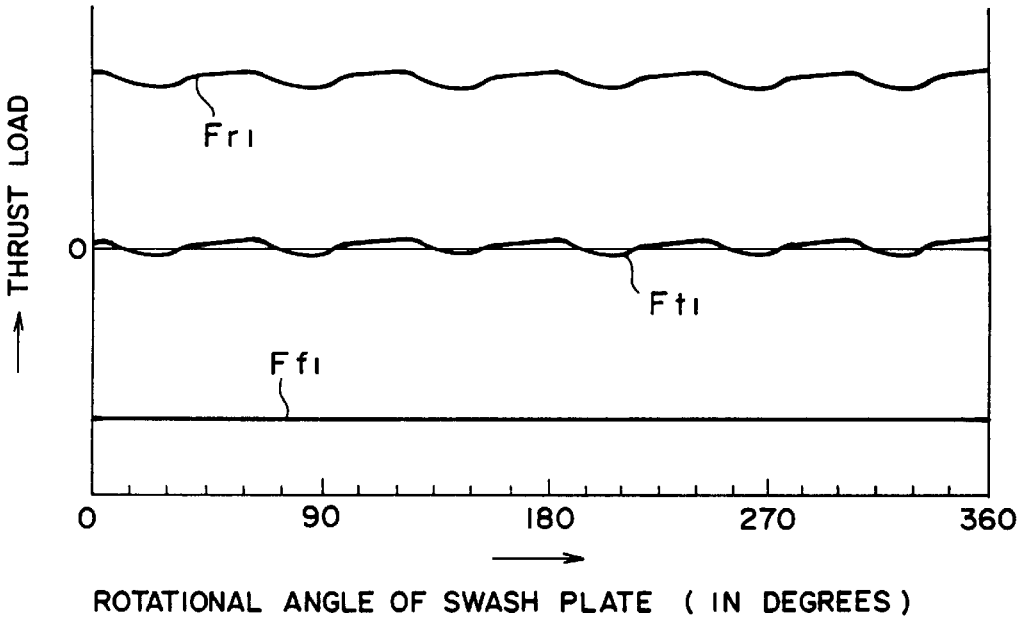
FIG. 3 is a graph explaining the balance of thrust loads in Embodiment 1 of the present invention.
Figure 4:
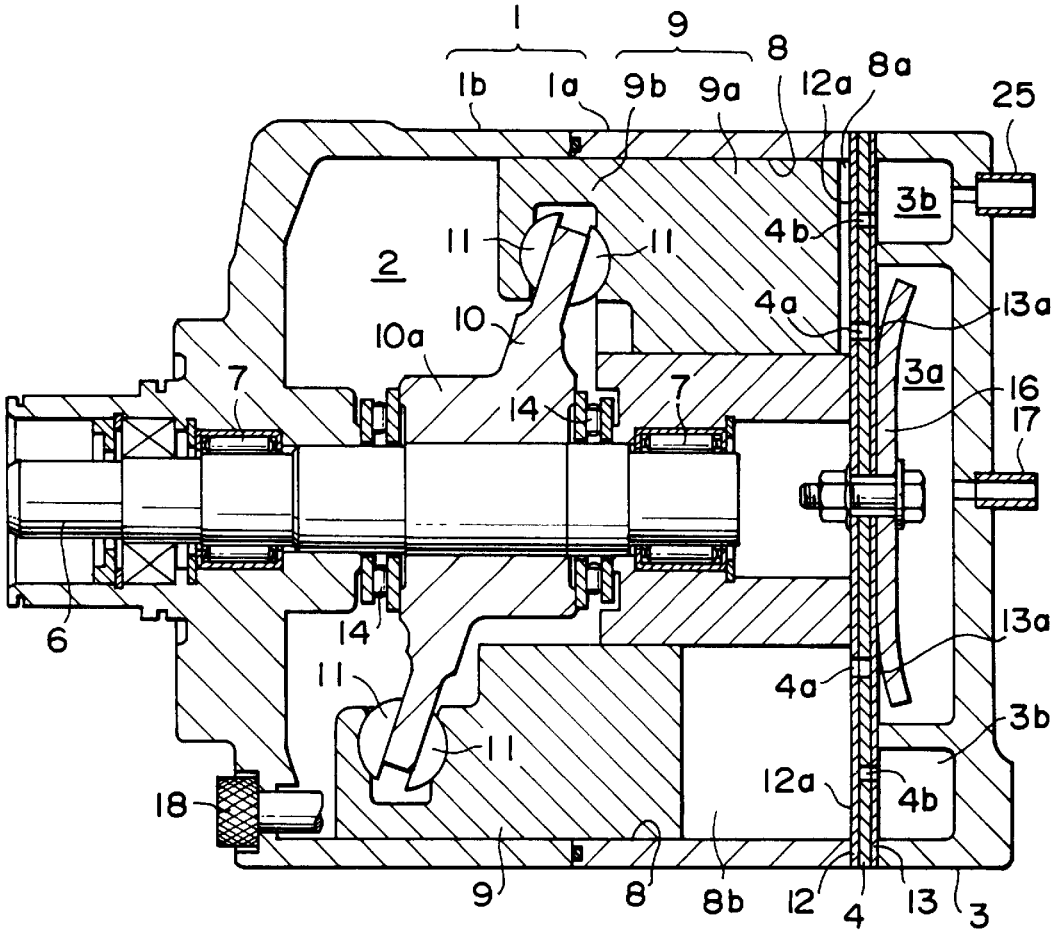
FIG. 4 is a longitudinal section of a single-ended swash plate compressor according to a variation of Embodiment 1 of the present invention.

For example, FIG. 3 shows the thrust load when the intermediate pressure is adjusted so that x is 0.33. This graph shows a case where there are six pistons 9*a*, Ff1 representing the thrust load acting from the front end towards the rear end, Fr1 representing the thrust load acting from the rear end towards the front end, and Ft1 representing the sum of both thrust loads (total load). As this graph shows, since Ff1 and Fr1 are practically balanced, Ft1 fluctuates only slightly in either axial direction.

Consequently, the thrust bearings 14 are not subjected to a large load. Furthermore, because the thrust bearings 14 are disposed at both the front end and the rear end of the swash plate 10, the total thrust load can be supported even if it fluctuates in both axial directions. As a result, the durability of the thrust bearings 14 is improved, and furthermore, because there is no need to use large thrust bearings, a contribution can be made to reducing the size of the compressor.

Moreover, the following modifications can be applied to Embodiment 1 of the present invention:

(1) In Embodiment 1 above, the adjustment valve 20 is housed in the cylinder block 1*a*, but the adjustment valve 20 may be disposed in any other appropriate space, such as the exterior, etc. Furthermore, the adjustment valve 20 is not limited to a bellows type, as any other type may be used;

(2) The compressor according to the present invention is not limited to use in a refrigerating cycle having carbon dioxide as a refrigerant; as it may be used in the refrigerating cycles for other refrigerants;

(3) In Embodiment 1 above, the increased pressure in the swash plate chamber 2 is caused by blowback gas when refrigerant inside the cylinder bores 8 leaks through the clearances between the pistons 9*a* and the cylinder bores 8 into the swash plate chamber 2, but suitable perforations may be disposed in the cylinder block 1*a* to positively connect the discharge chamber 3*a* to the swash plate chamber 2;

(4) The internal pressure of the swash plate chamber 2 may be adjusted by a restriction passage instead of the adjustment valve 20 of Embodiment 1 above; and (5) In Embodiment 1 above, the pressure in the swash plate chamber 2 is adjusted to an intermediate pressure by an adjustment valve 20, but the swash plate chamber 2 may be isolated from the discharge chamber 3*a* and the intake chamber 3*b* in a practically sealed condition. In that case, the swash plate chamber 2 is connected to compression chambers 8*a*, 8*b* (hereinafter simply "bores" in this variation) by the clearance between the pistons 9*a* and the cylinder bores 8.

Because the relationship between the pressure Pc in the swash plate chamber 2 and the pressure Pb1 in the bores 8*a* in the compression stage is Pb1≈Pd>Pc, blowback gas flows from the bores 8*a* into the swash plate chamber 2 due to the differences in pressure and pressure increases in the swash plate chamber 2. On the other hand, since the relationship between the pressure Pc in the swash plate chamber 2 and the pressure Pb2 in the bores 8*b* in the intake stage is Pb2≈Ps<Pc, gas instead moves from the swash plate chamber 2 into the bores 8*b*. Moreover, Ps is the intake pressure and Pd is the discharge pressure. Thus, the amount of gas moving from the bores 8*a* in the compression stage into the swash plate chamber 2 is balanced by the amount of gas moving from the swash plate chamber 2 into the bores 8*b* in the intake stage, and consequently the pressure of the swash plate chamber 2 is maintained at a predetermined intermediate pressure.

Embodiment 2

Next, Embodiment 2 embodying the swash plate compressor of the present invention will be explained using FIGS. 5 to 8.

Figure 5:
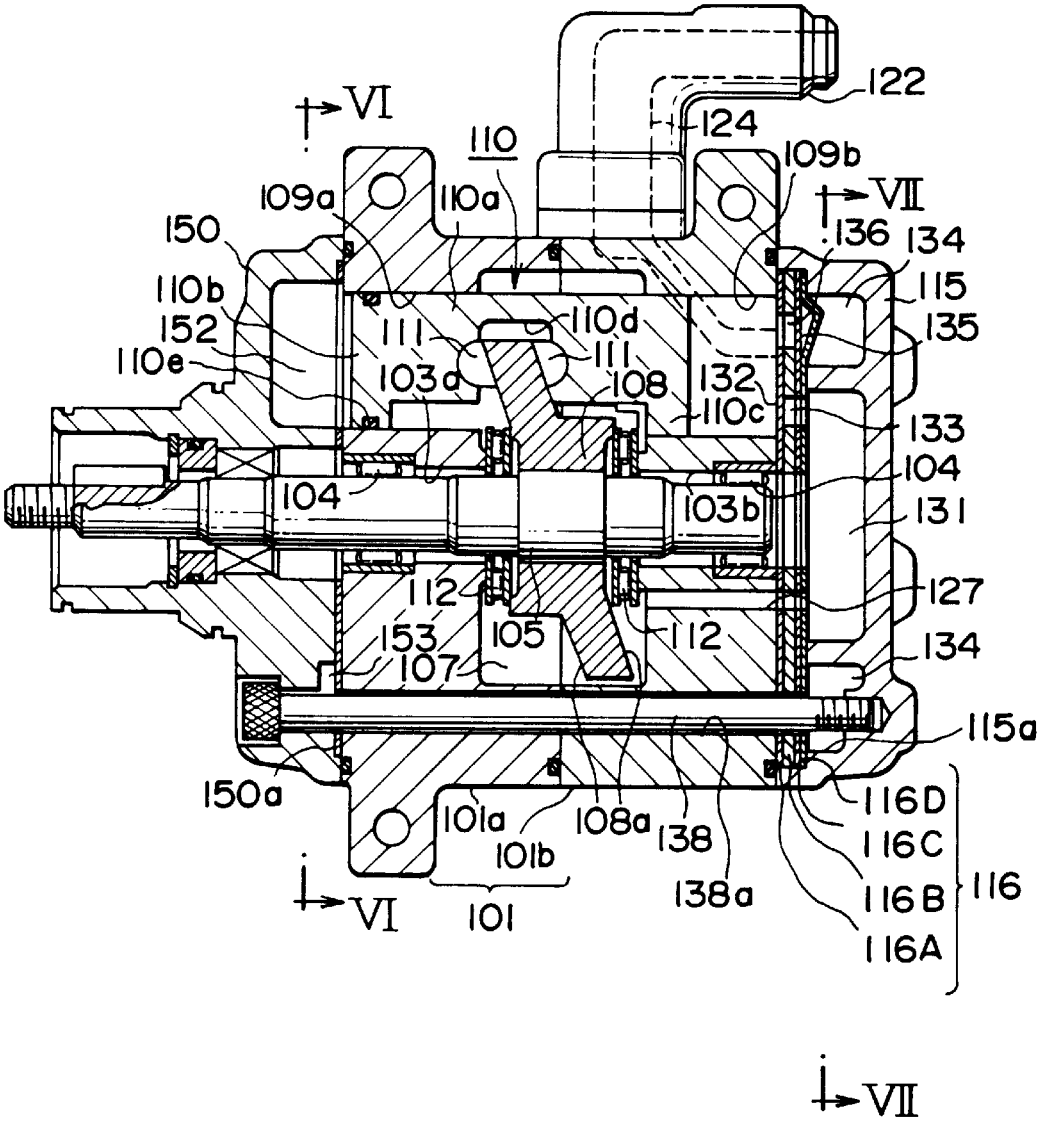
FIG. 5 is a longitudinal section of a single-ended swash plate compressor according to Embodiment 2 of the present invention taken along line V—V in FIG. 6.

The single-ended swash plate compressor according to Embodiment 2 has pistons in both the front end and the rear end, the pistons in one end only performing the compression action and the pistons in the other end performing only a guide action. FIG. 5 is a longitudinal section of this single-ended swash plate compressor, and in this figure, the cylinder assembly 101 is formed by joining a front cylinder block 101*a* and a rear cylinder block 101*b*. A space is formed in the center of the cylinder assembly 101 between the cylinder blocks 101*a*, 101*b* when the cylinder block 1*a* is joined to the cylinder block 1*b*, and this space constitutes a swash plate chamber 107. The swash plate chamber 107 connects to an intake passage (not shown) which is connected to an inlet 121.

Drive shaft openings 103*a*, 103*b* are formed in the center of the cylinder blocks 101*a*, 101i*b*, respectively. A drive shaft 105 is disposed in the center of the cylinder assembly 101 and is rotatably supported by radial bearings 104, which are disposed in the drive shaft openings 103*a*, 103*b*.

A swash plate 108 is disposed in the swash plate chamber 107 so as to be rotatable by the drive shaft 105, the boss portion of the swash plate 108 being fitted over and secured to the center of the drive shaft 105. Thrust bearings 112 are disposed between both the front end and the rear end of the boss portion of the swash plate 108 and the central inside end surfaces of the cylinder blocks 101*a*, 101*b* to support the load in both axial directions of the swash plate 108.

Six cylinder bores 109*a*, 109*b* are disposed equidistantly in a circle of prescribed radius around the drive shaft 105 in each of the cylinder blocks 101*a*, 101*b*. The cylinder bores 109*a* in the front cylinder block 101*a* and the cylinder bores 109*b* in the rear cylinder block 101*b* are disposed so as to form six pairs of cylinder bores, each pair having the same axial center. The cylinder bores 109*a* in the front end are used as guides, and the cylinder bores 109*b* in the rear end are used for compression.

Piston assemblies 110 each comprise: a piston rod 110*a*; a guide piston 110*b* formed on the front end of the piston rod 110*a*; and a compression piston 110*c* formed on the rear end of the piston rod 110*a*. The piston assemblies 110 are disposed such that each of the guide pistons 110*b* is housed in a cylinder bore 109*a* in the front end, and each of the compression pistons 110*c* is housed in a cylinder bore 109*b* in the rear end. A swash plate engaging portion 110*d* with a portal-shaped cross-section in the axial direction is formed in the center of each of the piston rods 110*a* and shoes 111 are engaged by these swash plate engaging portions 110*d*. The piston assemblies 110 are constructed so as to be engaged by the surface 108*a* of the swash plate 108 by means of these shoes 111 and to be reciprocated as the swash plate 108 rotates.

In this compressor, the front end surface of the cylinder assembly 101 constructed as described above is covered by a front housing 150 forming an outer shell. The rear end surface of the cylinder assembly 101 is covered by a rear housing 115 functioning as a cylinder cover by means of a valve plate assembly 116. These housings 150, 115 are joined and secured to the cylinder assembly 101 by means of a plurality of bolts 138. Moreover, 138*a* are bolt holes for leading the bolts 138 from the front housing 150 to the valve plate assembly 116. The front housing 150 is joined to the front end surface of the cylinder assembly 101 by means of a gasket 150*a*, two intake pressure chambers 151 and two discharge pressure chambers 152 being formed therein as shown in FIG. 6.

Figure 6:
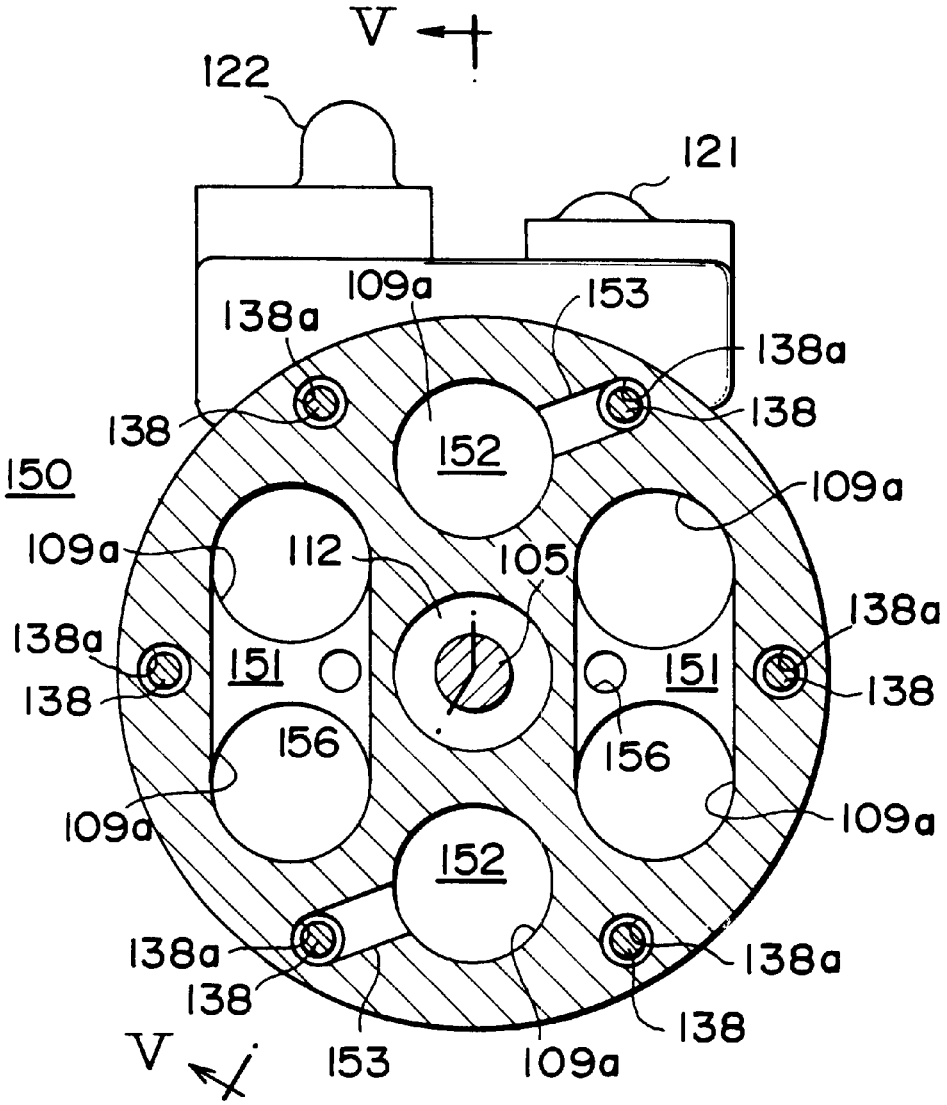
FIG. 6 is a cross-section taken along line VI—VI in FIG. 5.
Figure 7:
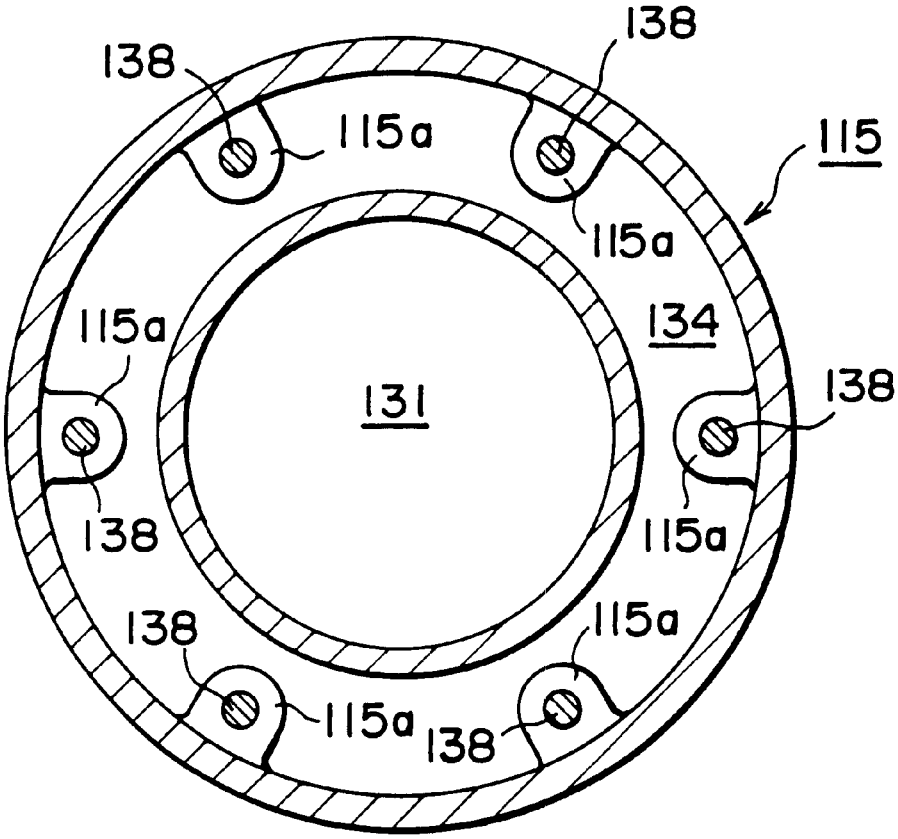
FIG. 7 is a cross-section taken along line VII—VII in FIG. 5.

As shown in FIG. 6, the intake pressure chambers 151 are each formed in an oval shape so as to connect two cylinder bores 109*a*, and are disposed on the left and right in FIG. 6. Furthermore, the intake pressure chambers 151 are connected to the swash plate chamber 107 by connecting passages 156 which pass through the length of the front end cylinder block 101*a*.

The discharge pressure chambers 152, on the other hand, are positioned over the two cylinder bores 109*a* lying between the intake pressure chambers 151, and form an approximately cylindrical space with a diameter approximately equal to that of the two cylinder bores 109*a*. Furthermore, the discharge pressure chambers 152 are each connected to one of the bolt holes 138*a* formed around the bolts 138 by connecting grooves 153 cut into the end surface of the cylinder assembly 101 of the front housing 150.

At the same time, the interior of the rear housing 115 is divided into two concentric spaces by a partition. The inner of these divided spaces is connected to the swash plate chamber 107 by means of a plurality of connecting passages 127 formed in the cylinder block 101*b*, forming an intake chamber 131. Furthermore, the intake chamber 131 is connected to the rear cylinder bores 109*b* by means of intake ports 133 and intake valves 132 described below. The outer of the spaces within the rear housing 115 forms a discharge chamber 134 connected to each of the cylinder bores 109*b* by means of discharge ports 136 and discharge valves 135 described below. Furthermore, the discharge chamber 134 is connected to a discharge outlet 122 by means of a discharge passage 124.

The valve plate assembly 116 is formed by disposing an intake valve-forming plate 116A, a valve plate 116B, a discharge valve-forming plate 116C, and a retainer gasket 116D in order from the cylinder assembly 101 side, and is held between the cylinder assembly 101 and the cylinder cover 115.

The valve plate 116B is perforated by a plurality of intake ports 133 connecting the intake chamber 131 to each of the cylinder bores 109*b*, and a plurality of discharge ports 136 connecting the discharge chamber 134 to each of the cylinder bores 109*b*. The intake valve-forming plate 116A is integrally formed with a plurality of intake valves 132 for individually controlling the opening and closing of each of the intake ports 133. The discharge valve-forming plate 116C is integrally formed with a plurality of discharge valves 135 for individually controlling the opening and closing of each of the discharge ports 136. The retainer gasket 116D is integrally formed with a plurality of retainers for individually regulating the opening angle of each of the discharge valves 135.

As can be seen from FIG. 5, by making the walls 115*a* of the discharge chamber 134 in the rear end surrounding the bolt holes 138*a* shorter, the valve plate assembly 116 ends of the bolt holes 138*a* are opened to the discharge chamber 134, whereby the bolt holes 138*a* and the discharge chamber 134 are connected.

When a single-ended swash plate compressor constructed in the above manner is driven, intake gas is drawn from the external refrigerant circuit through the inlet 121 into the swash plate chamber 107. Then, the intake gas flows through the connecting passages 127 to the intake chamber 131. Next, this intake gas is sucked through the intake ports 133 and the intake valves 132 into the cylinder bores 109*b* and is compressed by the compression pistons 110*c*. The compressed refrigerant gas is discharged through the discharge ports 136 and the discharge valves 135 to the discharge chamber 134. During this compression operation, because the intake pressure chamber 151 in the front housing 150 is connected to the swash plate chamber 107 by means of the connecting passages 156, low pressure is constantly being introduced into the intake pressure chamber 151. Consequently, the inside of the cylinder bores 109*a* in the front end directly connected to the intake pressure chamber 151 are constantly maintained at low pressure. At the same time, because the discharge pressure chamber 152 in the front housing 150 is connected to the discharge chamber 134 by means of the bolt holes 138*a*, discharge pressure is constantly being introduced into the discharge pressure chamber 152, and therefore the cylinder bores 109*a* directly connected thereto are constantly maintained at discharge pressure.

Figure 8:
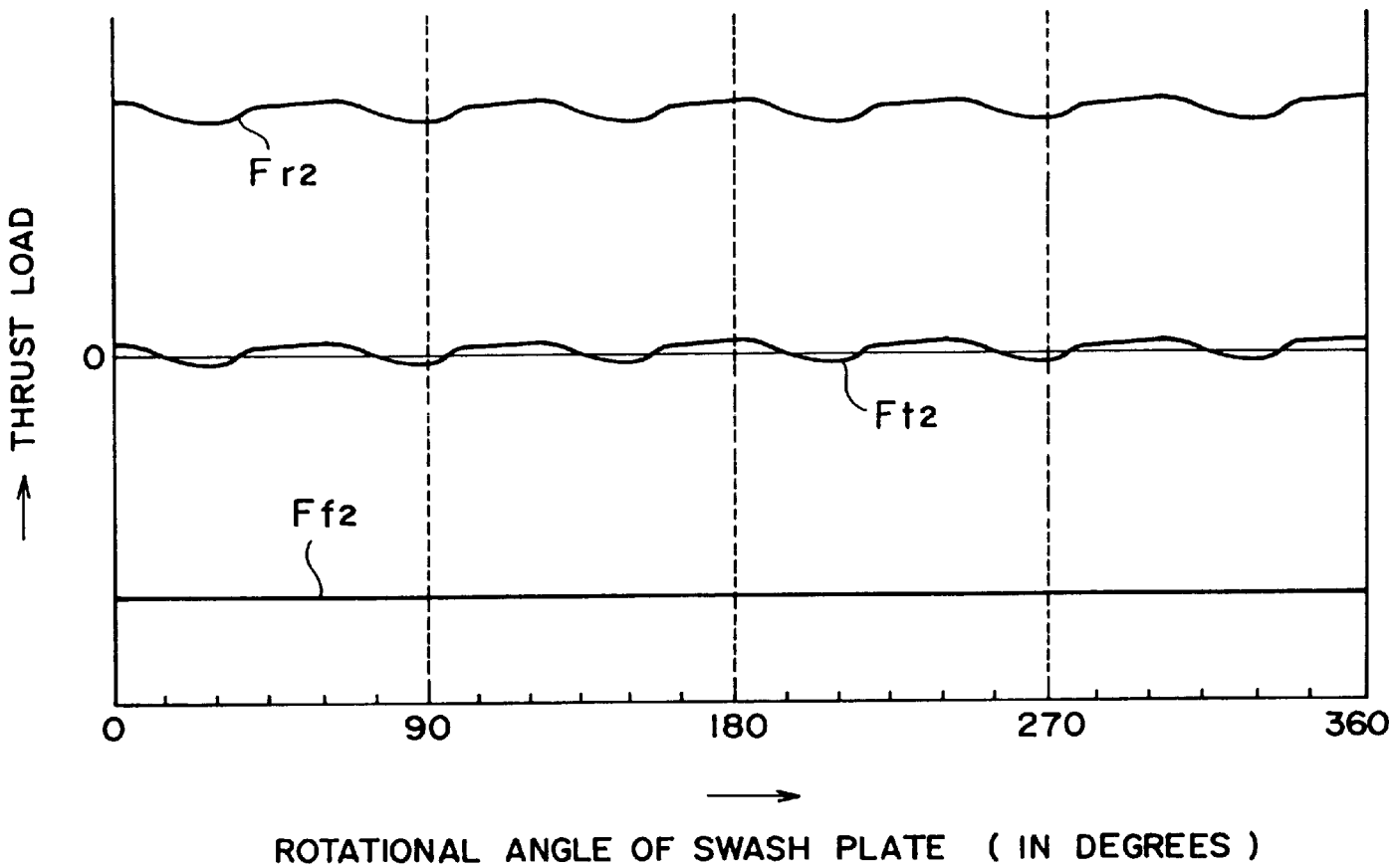
FIG. 8 is a graph explaining the balance of thrust loads in Embodiment 2.

Consequently, at the front end of the piston assemblies 110 during the compression operation, low pressure acts on the surfaces of the four guide pistons 110*b* exposed to low pressure and discharge pressure acts on the surfaces of the two guide pistons 110*b* exposed to discharge pressure. At the same time, at the rear end of the piston assemblies 110, the internal pressure of the cylinder bores 109*b*, which changes between intake pressure and discharge pressure due to the compression action, acts on the surface of each of the compression pistons 110*c*. FIG. 8 is a graph showing the thrust loads acting on a six-piston assembly 110 due to such pressure conditions, Ff2 representing the thrust load acting from the front end towards the rear end, Fr2 representing the thrust load acting from the rear end towards the front end, and Ft2 representing the total load being the sum of these thrust loads Ff2 and Fr2. As can be seen from this graph, the thrust load acting from the front end towards the rear end Ff2 and the thrust load acting from the rear end towards the front end Fr2 are practically balanced and the sum of these two thrust loads (total load) Ft2 fluctuates only slightly in either axial direction, exhibiting no great imbalances in load. Consequently, this total load Ft2 shows the same magnitude and variance as the total thrust load Ftl in Embodiment 1 above.

Moreover, if the cylinder bores other than the cylinder bores into which discharge pressure of the front end cylinder bores 109*a* is introduced are constructed without purposely introducing intake pressure and are not controlled, there is a possibility that the internal pressure therein will rise due to the leaking of refrigerant from the discharge pressure side to the low pressure side and there is a risk that the balance of the thrust loads in either axial direction will shift as operating time increases. However, by purposely introducing intake gas as in Embodiment 2, the internal pressure therein and the balance of thrust loads in either axial direction are stabilized.

Furthermore, since in this case, the two cylinder bores 109*a* in the front end whose internal pressure is discharge pressure and the four cylinder bores 109*a* in the front end whose internal pressure is intake pressure are disposed symmetrically about the axial center of the drive shaft, the moments about the center of the swash plate due to the thrust loads acting on each of the pistons are in a mutually cancelling relationship, reducing deformation of the drive shaft 105 and load on the radial bearings 104.

Furthermore, in the guide pistons 110*b*, if piston rings 110*e* are mounted on the outer circumferential surfaces of the two pistons in which the internal pressure of the cylinder bores 109*a* is discharge pressure, blowback gas from these cylinder bores 109*a* to the swash plate chambers 107 is reduced, improving compression efficiency.

Embodiment 3

Next, Embodiment 3 will be explained on the basis of FIGS. 9 to 11. Moreover, since Embodiment 3 has many points in common with Embodiment 2 above, identical structural elements will be given identical reference numerals and explanations thereof will be simplified.

As in the case of Embodiment 2, Embodiment 3 has six pairs of cylinder bores 109*a*, 109*b*, the difference being that in Embodiment 3 discharge pressure is introduced into every second cylinder bore 109*a*. Moreover, FIG. 9 is a cross-section similar to that of FIG. 5 for Embodiment 2 above, but the section is taken along a line passing through two cylinder bores positioned symmetrically relative to the center of the drive shaft (line IX—IX in FIG. 10). Furthermore, FIG. 10 is a cross-section of a front housing 160 taken along line X—X in FIG. 9.

Figure 9:
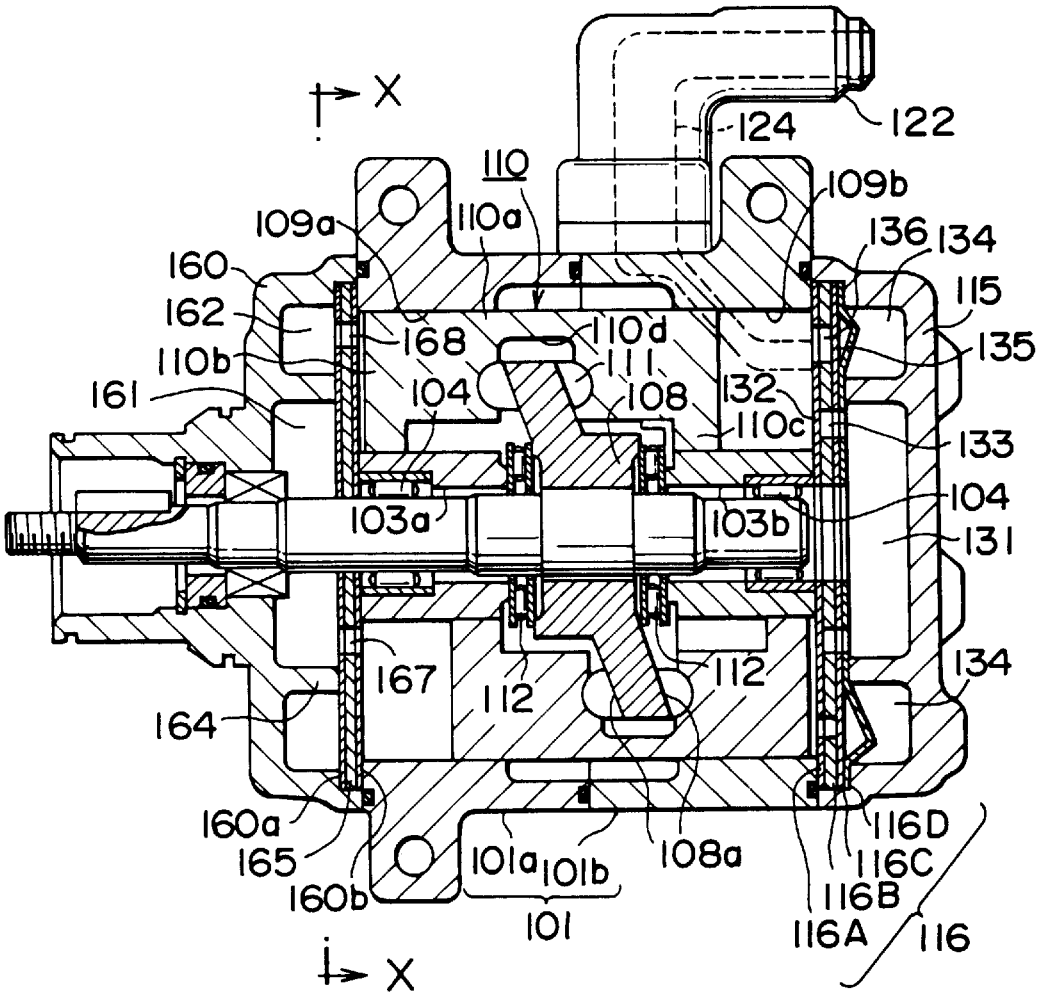
FIG. 9 is a longitudinal section of a single-ended swash plate compressor according to Embodiment 3 of the present invention taken along line IX—IX in FIG. 10.
Figure 10:
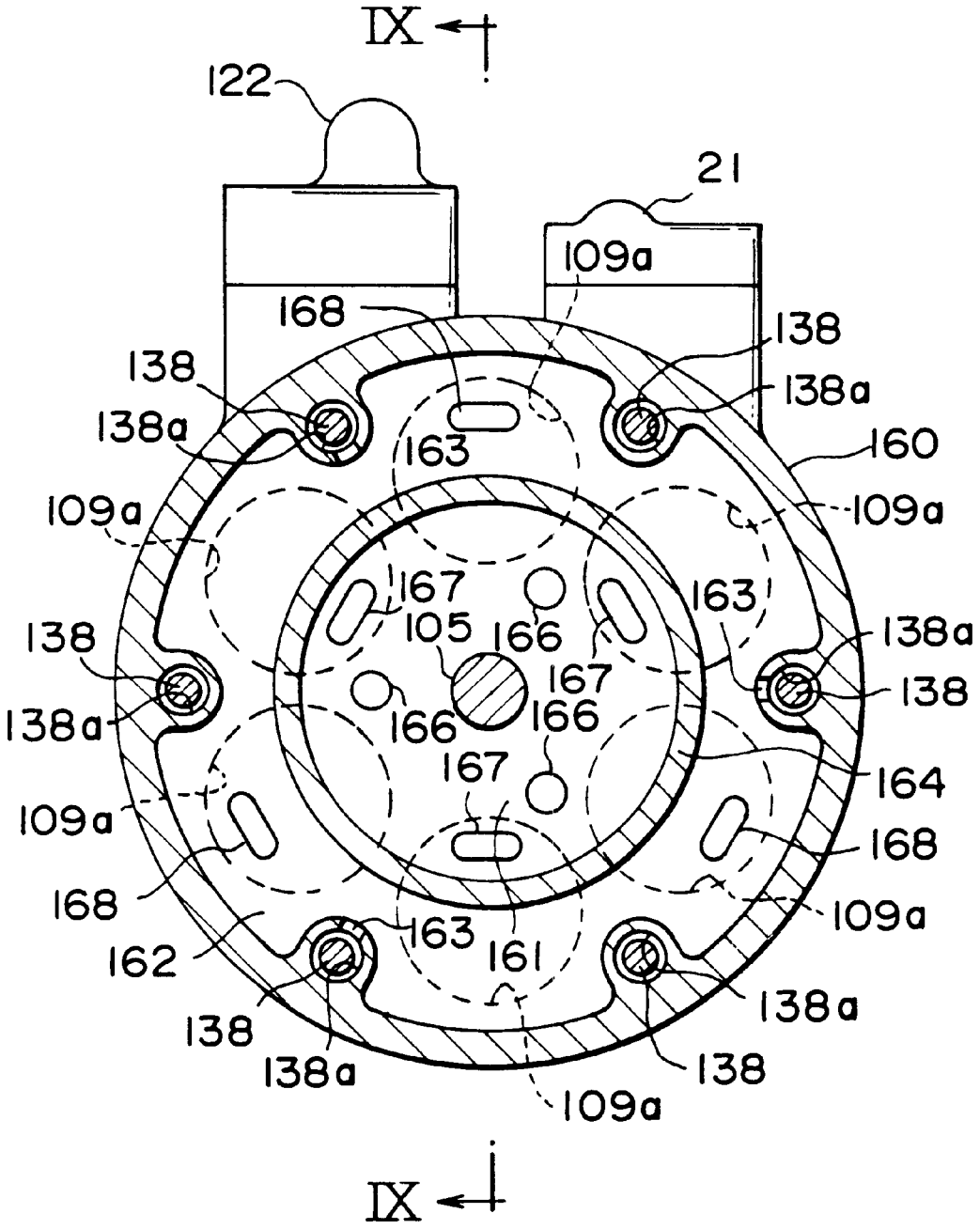
FIG. 10 is a cross-section taken along line X—X in FIG. 9.

In FIG. 9, a front housing 160 is joined to the front end surface of the cylinder assembly 101 by means of a plate 165 so as to cover the cylinder assembly 101. Gaskets 160*a*, 160*b* are disposed between the plate 165 and the front housing 160, and between the plate 165 and the cylinder assembly 101, respectively, so as to seal the joints. As can be seen from FIG. 10, the interior of the front housing 160 is divided into two concentric chambers by a partition 164 formed integrally with the front housing 160 so as to protrude inwards from the end wall thereof, the inner chamber forming an intake pressure chamber 161 and the outer chamber forming a discharge pressure chamber 162.

As in Embodiment 2, the intake pressure chamber 161 is connected to the swash plate chamber 107 by connecting passages 166 (see FIG. 10) running the length of the front end cylinder bores 109*a*. Furthermore, the intake pressure chamber 161 is constantly connected to three alternately-positioned cylinder bores 109*a* by intake gas passage holes 167 disposed in the plate 165. Consequently, intake pressure is constantly introduced into these cylinder bores 109*a* during operation.

Three connecting grooves 163 (see FIG. 10) connecting the bolt holes 138*a* to the discharge pressure chamber 162 are cut into the end surface of the front housing 160. As in the case of Embodiment 2, these bolt holes 138*a* are connected to the discharge chamber 134 within the cylinder cover 115. In addition, the remaining cylinder bores 109*a* other than the cylinder bores connected to the intake pressure chamber 161 are constantly connected to the discharge pressure chamber 162 by discharge gas passage holes 168 disposed in the plate 165. Consequently, discharge pressure is constantly introduced into these cylinder bores 109*a* during operation. Moreover, the intake gas passage holes 167 and the discharge gas passage holes 168 are formed sufficiently large so that no compression action occurs within the guide end cylinder bores 109*a*.

As a result of this construction, intake pressure and discharge pressure act on the front end surfaces of alternate guide pistons 110*b* respectively, the acting thrust loads being based on this pressure.

Figure 11:
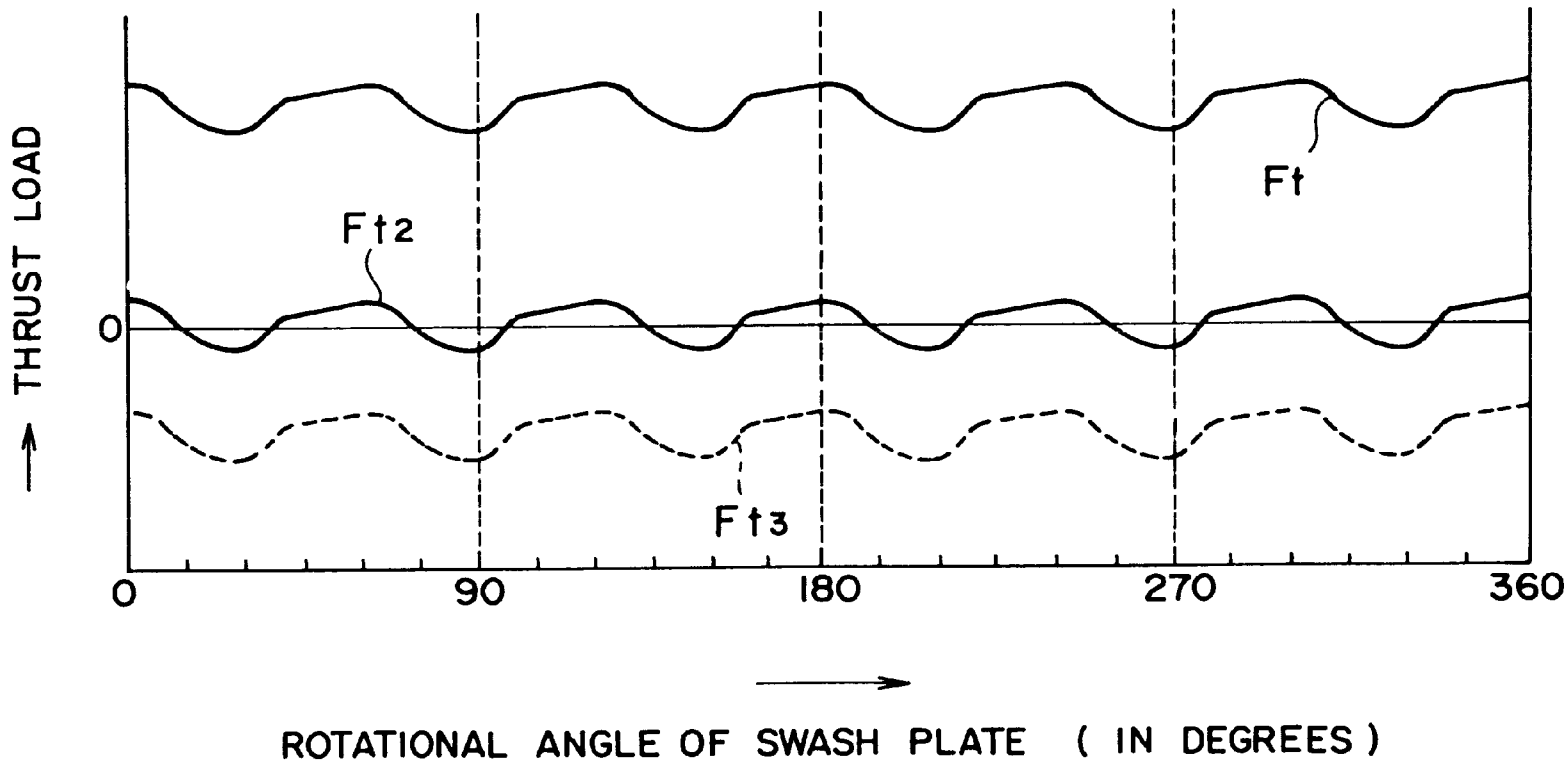
FIG. 11 is a graph explaining the balance of thrust loads in Embodiment 3 in comparison to those of Embodiment 2 and a conventional example.

FIG. 11 is a graph showing the total load Ft3 being the sum of the thrust loads acting on a six-piston assembly 110 in both axial directions, showing the total load Ft2 acting in the case of Embodiment 2 and the thrust load Ft acting in the case of the conventional example for comparison. For each of these curves, carbon dioxide has been used as the refrigerant. Consequently, it can be seen that when the refrigerant is carbon dioxide, introduction of discharge gas into two of the cylinder bores 109*a*, as in Embodiment 2, gives the best balance of thrust loads. However, Embodiment 3 is still an improvement over the conventional technique. Furthermore, the present embodiment may be preferable depending on the type of refrigerant.

Concerning the moments about the center of the swash plate 7 mentioned in Embodiment 2, the present embodiment is preferable because it is more evenly balanced in all directions.

Embodiment 4

Next, Embodiment 4 will be explained on the basis of FIG. 12. Moreover, since Embodiment 4 has many points in common with Embodiments 2 and 3 above, structural elements identical to those in Embodiments 2 and 3 will be given identical reference numerals and explanations thereof will be simplified.

As in the case of Embodiments 2 and 3, Embodiment 4 has six pairs of cylinder bores 109*a*, 109*b*, the difference being that in Embodiment 4 the diameter of the front end cylinder bores 109*a* is made smaller than the diameter of the rear end cylinder bores 109*b*, and the cross-sectional area of the guide pistons is made smaller than that of the compression pistons, and in addition, discharge pressure is introduced into all of the front end cylinder bores 109*a*. Moreover, FIG. 12 is a cross-section similar to that of FIG. 5 for Embodiment 2 above.

Figure 12:
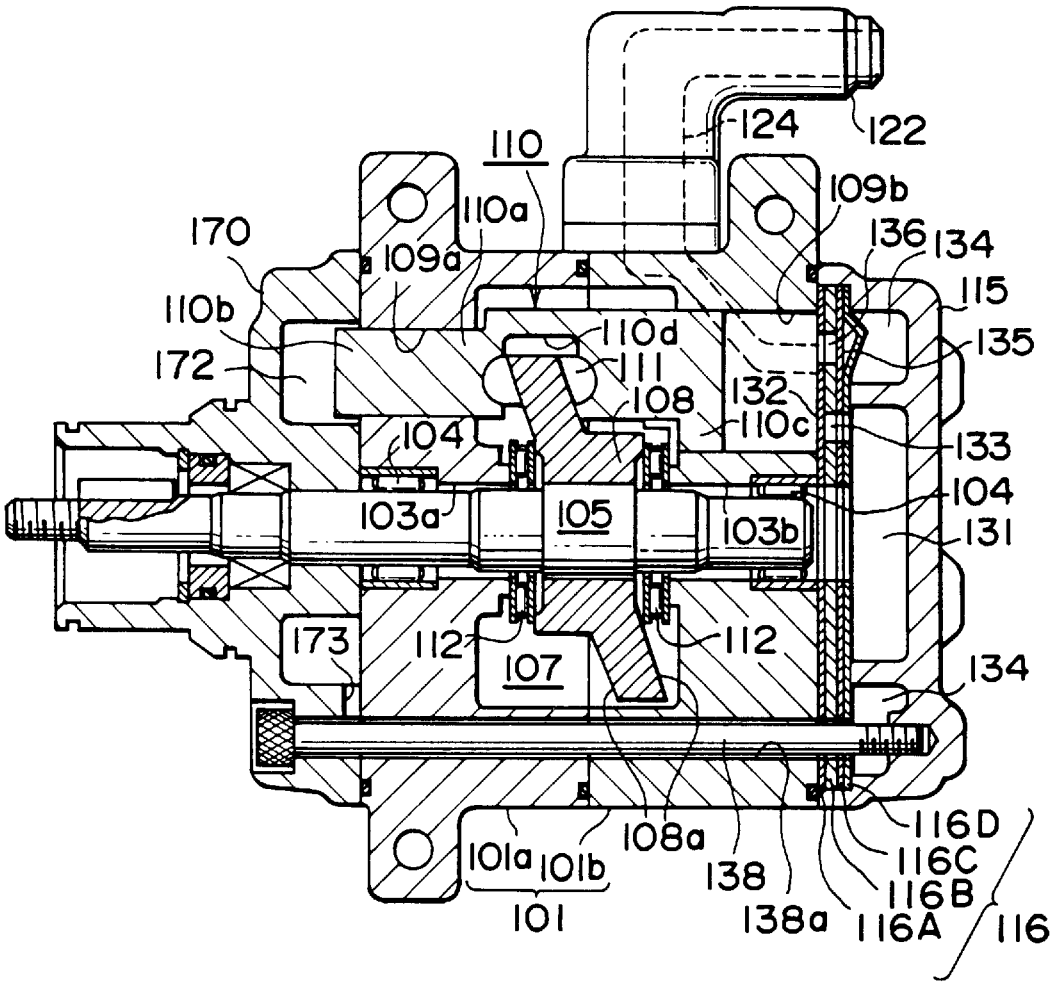
FIG. 12 is a longitudinal section of a single-ended swash plate compressor according to Embodiment 4 of the present invention.

As shown in FIG. 12, a front housing 170 is connected to the front end surface of the cylinder assembly 101. The interior of the front housing 170 is formed into a single chamber functioning as a discharge pressure chamber 172. The construction for introducing discharge gas to the discharge pressure chamber 172 is similar to that in Embodiment 2 and is achieved by connecting the discharge pressure chamber 172 to the bolt holes 138*a* by means of connecting grooves 173 cut into the end surface of the front housing 170 and connecting the bolt holes 138*a* to the discharge chamber 134 in the cylinder cover 115. Furthermore, since there is no need to limit the reciprocation of the guide pistons 110*b* to within the cylinder bores 109*a*, when any of the compression pistons 110*c* is at bottom dead center, the end of the corresponding guide piston 110*b* projects into the discharge pressure chamber 172 as shown in FIG. 12, allowing the size of the compressor to be reduced.

In this construction, the balance of thrust loads can be variously altered by changing the cross-sectional area of the guide pistons 110*b*. Consequently, the acting thrust loads and the balance of thrust loads in both axial directions may change depending on the refrigerant, but the balance of thrust loads in both axial directions can be adjusted by means of the designed cross-sectional area of the pistons 110*b*, 110*c*.

Thus, by making the guide pistons 110*b* smaller, the force required to drive the piston assemblies 110 is reduced, enabling the efficiency of the compressor to be improved.

Moreover, the reduction of the size of the guide pistons 110*b* as in Embodiment 4 can also be applied to Embodiments 2 and 3 above.

What is claimed is:

1. A single-ended swash plate compressor comprising:

a cylinder assembly having a plurality of cylinder bores disposed in only the rear of said cylinder assembly and parallel to the axial center thereof;

a cylinder cover joined to the rear end of said cylinder assembly, having an intake chamber and a discharge chamber therein;

an outer shell formed by joining a front housing to the front end of said cylinder assembly;

a swash plate chamber formed within said outer shell;

a drive shaft disposed at the axial center of said outer shell so as to extend from an axial center portion of said cylinder assembly;

a swash plate secured to said drive shaft so as to rotate together with said drive shaft within said swash plate chamber;

single-headed pistons housed in said cylinder bores so as to be reciprocated in both axial directions by said swash plate, wherein a compression action is performed at one end of said cylinder bores; and a means for practically balancing thrust loads acting on said pistons in both axial directions by adjusting the refrigerant pressure acting in the axial direction opposite to the trust load acting on said pistons due to the internal pressure of said cylinder bores.

2. The single-ended swash plate compressor according to claim 1 wherein thrust bearings are disposed at both the front end and the rear end of said swash plate.

3. A single-ended swash plate comprising:

a cylinder block having a plurality of cylinder bores disposed in only the rear of said cylinder block and parallel to the axial center thereof;

a cylinder cover joined to the rear end of said cylinder block, having an intake chamber and a discharge chamber therein;

an outer shell formed by joining a front housing to the front end of said cylinder block;

a swash plate chamber formed within said outer shell when said cylinder block and said front housing are joined;

a drive shaft disposed at the axial center of said outer shell so as to extend from an axial center portion of said cylinder block;

a swash plate secured to said drive shaft so as to rotate together with said drive shaft within said swash plate chamber;

single-headed pistons formed on the rear end of piston rods housed in said plurality of cylinder bores so as to be reciprocated in both axial direction by said swash plate, wherein a compression action is performed at the rear end of said cylinder bores; and an adjustment means for adjusting the internal pressure of said swash plate chamber acting on the front end surfaces of said pistons to an intermediate pressure between the intake pressure and the discharge pressure;

the thrust load directed towards said front end due to the internal pressure of said cylinder bores acting on said pistons and the thrust load directed towards said rear end due to the internal pressure of said swash plate chamber acting on said pistons being practically balanced by said adjustment means.

4. The single-ended swash plate compressor according to claim 3 wherein:

an intake port for introducing intake gas from a refrigerant circuit outside said compressor is disposed so as to be connected to an intake chamber;

said intake chamber and said swash plate chamber are connected by an adjustment valve which forms said adjustment means; and said adjustment means is constructed such that said swash plate chamber is maintained at a predetermined intermediate pressure by the action thereof.

5. The single-ended swash plate compressor according to claim 3 wherein the relationship between said intake pressure Ps, said discharge pressure Pd, and said intermediate pressure Pm is:

$$Pm \approx Ps*(1-x)+Pd*x,$$

provided that x=0.25 to 0.4.

6. A single-ended swash plate compressor comprising:

a cylinder assembly having a swash plate chamber formed within said cylinder assembly, with a plurality of cylinder guide bores in the front end thereof and a plurality of cylinder compression bores in the rear end thereof;

a drive shaft disposed in a central portion of said cylinder assembly;

piston assemblies having pistons formed on both ends of piston rods, each piston assembly having one end housed in a cylinder guide bore and the other end housed in a cylinder compression bore;

a swash plate housed in said swash plate chamber which rotates together with said drive shaft and reciprocates said piston assemblies;

a cylinder guide cover joined to the front end of said cylinder assembly;

a cylinder compression cover joined to the rear end of said cylinder assembly, having an intake chamber and a discharge chamber therein;

the cylinder compression bores being connected to said discharge chamber and said intake chamber by means of a discharge valve and an intake valve, a compression action being performed by the pistons housed within said cylinder compression bores, and a guide action being performed by the pistons housed within said cylinder guide bores; and a pressure supply means for introducing pressure into said cylinder guide bores to cancel reactive forces due to compression acting on said pistons in said cylinder compression bores.

7. The single-ended swash plate compressor according to claim 6 wherein said pressure supply means comprises a discharge pressure supply means for introducing discharge pressure into at least some of said cylinder bores in said guide end.

8. The single-ended swash plate compressor according to claim 7 wherein said pressure supply means comprises an intake pressure supply means for introducing intake pressure into the cylinder bores in said guide end into which discharge pressure is not introduced.

9. The single-ended swash plate compressor according to claim 7 wherein piston rings are mounted on the outer circumferential sliding surfaces of said pistons housed in said cylinder bores in said guide end into which said discharge pressure is introduced.

* * * * *

UNITED STATES PATENT AND TRADEMARK OFFICE

CERTIFICATE OF CORRECTION

PATENT NO. : 6,280,151 B1
DATED : August 28, 2001
INVENTOR(S) : Kazuo Murakami et al.

It is certified that error appears in the above-identified patent and that said Letters Patent is hereby corrected as shown below:

Title page,
Item [56], References Cited, FOREIGN PATENT DOCUMENTS, please change "0 864 751 A2 9/1996 (EP)" to -- 0 864 751 A2 9/1998 (EP) --;

Column 1,
Line 23, please change "to chloro fluorocarbons, there" to -- to chlorofluorocarbons, there --;

Column 3,
Line 26, please change "when chloro fluorocarbons or the" to -- when chlorofluorocarbons or the --;

Column 4,
Lines 16-17, please change
"for chloro
fluorocarbons as a" to -- for chloro-
fluorocarbons as a --;

Signed and Sealed this

Thirteenth Day of August, 2002

*Attest:*

*Attesting Officer*

JAMES E. ROGAN
*Director of the United States Patent and Trademark Office*